US007930892B1

(12) United States Patent
Vonderhaar

(10) Patent No.: US 7,930,892 B1
(45) Date of Patent: Apr. 26, 2011

(54) REFRIGERATOR WITH CONTINUOUS VACUUM INSULATION

(75) Inventor: John J. Vonderhaar, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/713,578

(22) Filed: Feb. 26, 2010

(51) Int. Cl.
*F25B 19/00* (2006.01)

(52) U.S. Cl. ..... 62/100; 62/268

(58) Field of Classification Search ..... 62/100, 62/169, 268, 270; 99/468, 472; 426/231, 426/524
See application file for complete search history.

(56) References Cited

U.S. PATENT DOCUMENTS

| | | | | |
|---|---|---|---|---|
| 3,608,023 | A | 9/1971 | Scarborough | |
| 3,619,447 | A | 11/1971 | Kerna et al. | |
| 5,252,408 | A | 10/1993 | Bridges et al. | |
| 6,090,422 | A * | 7/2000 | Taragan et al. | 426/231 |
| 6,106,449 | A | 8/2000 | Wynne | |
| 6,158,233 | A | 12/2000 | Cohen et al. | |
| 6,217,140 | B1 * | 4/2001 | Hirath et al. | 312/406 |
| 6,220,685 | B1 * | 4/2001 | Hirath et al. | 312/406 |
| 6,257,684 | B1 * | 7/2001 | Hirath et al. | 312/406.1 |
| 6,375,292 | B2 * | 4/2002 | Nishimoto | 312/406 |
| 6,393,798 | B1 * | 5/2002 | Hirath et al. | 52/788.1 |
| 6,598,283 | B2 | 7/2003 | Rouanet et al. | |
| 6,623,413 | B1 | 9/2003 | Wynne | |
| 7,360,371 | B2 * | 4/2008 | Feinauer et al. | 62/169 |
| 7,669,434 | B2 * | 3/2010 | Leclear et al. | 62/331 |
| 2009/0193760 | A1 | 8/2009 | Leclear et al. | |
| 2009/0194193 | A1 | 8/2009 | Vonderhaar et al. | |

* cited by examiner

*Primary Examiner* — Mohammad M Ali
(74) *Attorney, Agent, or Firm* — John W. Morrison; McKee, Vorhees & Sease PLC

(57) ABSTRACT

A refrigerator includes a refrigerator housing, a refrigerated compartment disposed within the refrigerator housing, and a hollow refrigerator wall having insulation material therein. There is a first fluid connection from the vacuum pump to the hollow refrigerator wall for providing a first function of evacuating air from the hollow refrigerator wall and a second fluid connection from the vacuum pump for providing a second function of evacuating air.

18 Claims, 6 Drawing Sheets

REFRIGERATOR WITH CONTINUOUS VACUUM INSULATION

FIELD OF THE INVENTION

The present invention relates to refrigerators, more particularly, the present invention relates to refrigerators having a vacuum pump device.

BACKGROUND OF THE INVENTION

Refrigerators may include vacuum pump devices. Examples of such refrigerators are disclosed in U.S. Patent Application No. 2009/0193760 and U.S. Patent Application No. 2009/0194193, both of which are herein incorporated by reference. Uses of vacuum pump devices include applying the vacuum to a compartment within the refrigerator or using the vacuum pump device to seal a container.

The addition of a vacuum pump device adds to the cost and complexity of a refrigerator, thus the addition of vacuum pump device to evacuate a compartment or to seal a container may not justify the added cost to a manufacturer or a consumer. What is needed is a refrigerator with a vacuum pump device which provides added functionality.

BRIEF SUMMARY OF THE INVENTION

Therefore, it is a primary object, feature, or advantage of the present invention to improve over the state of the art.

It is a further object, feature, or advantage of the present invention to use a vacuum pump device within a refrigerator to improve insulation of the refrigerator.

It is a still further object, feature, or advantage of the present invention to use a single vacuum pump device within a refrigerator for multiple functions.

Another object, feature, or advantage of the present invention is to use a single vacuum pump device within a refrigerator to improve insulation of the refrigerator as well as providing additional functionality such as to air evacuate a compartment or to seal a container.

Yet another object, feature, or advantage of the present invention is to provide a refrigerator with a single vacuum pump which may simultaneously perform multiple purposes.

One or more of these and/or other objects, features, or advantages of the present invention will become apparent from the specification and claims that follow. No single embodiment of the present invention need exhibit all of these objects, features, or advantages.

According to one aspect of the present invention, a refrigerator is provided. The refrigerator includes a refrigerator housing and a refrigerated compartment disposed within the refrigerator housing. The refrigerator housing includes a hollow refrigerator wall having insulation material therein. The refrigerator further includes a vacuum pump. There is a first fluid connection from the vacuum pump to the hollow refrigerator wall for providing a first function of evacuating air from the hollow refrigerator wall for improved insulation. There is a second fluid connection from the vacuum pump for providing a second function of evacuating air for improved food preservation.

According to another aspect of the present invention, a method of using a refrigerator is provided. The method includes providing the refrigerator, the refrigerator including (a) a refrigerator housing, (b) a refrigerated compartment disposed within the refrigerator housing, (c) the refrigerator housing including a hollow refrigerator wall having insulation material therein, and (d) a vacuum pump. The method further includes evacuating air from the hollow refrigerator wall using the vacuum pump and altering state of a valve associated with the vacuum pump to divert vacuum suction from the vacuum pump for performing a second function.

According to another aspect of the present invention, a refrigerator includes a refrigerator housing, a machine compartment disposed within the refrigerator housing, a fresh food compartment disposed within the refrigerator housing, and a freezer compartment disposed within the refrigerator housing. The refrigerator housing may include a hollow refrigerator wall having insulation material therein. The refrigerator also includes a vacuum pump disposed within the machine compartment and a valve associated with the vacuum pump to divert vacuum suction from the vacuum pump through either a first path to the hollow refrigerator wall to provide a first function of evacuating air from the hollow refrigerator wall or through a second path to perform a second function.

DETAILED DESCRIPTION OF THE PREFERRED EMBODIMENT

Figure 1:
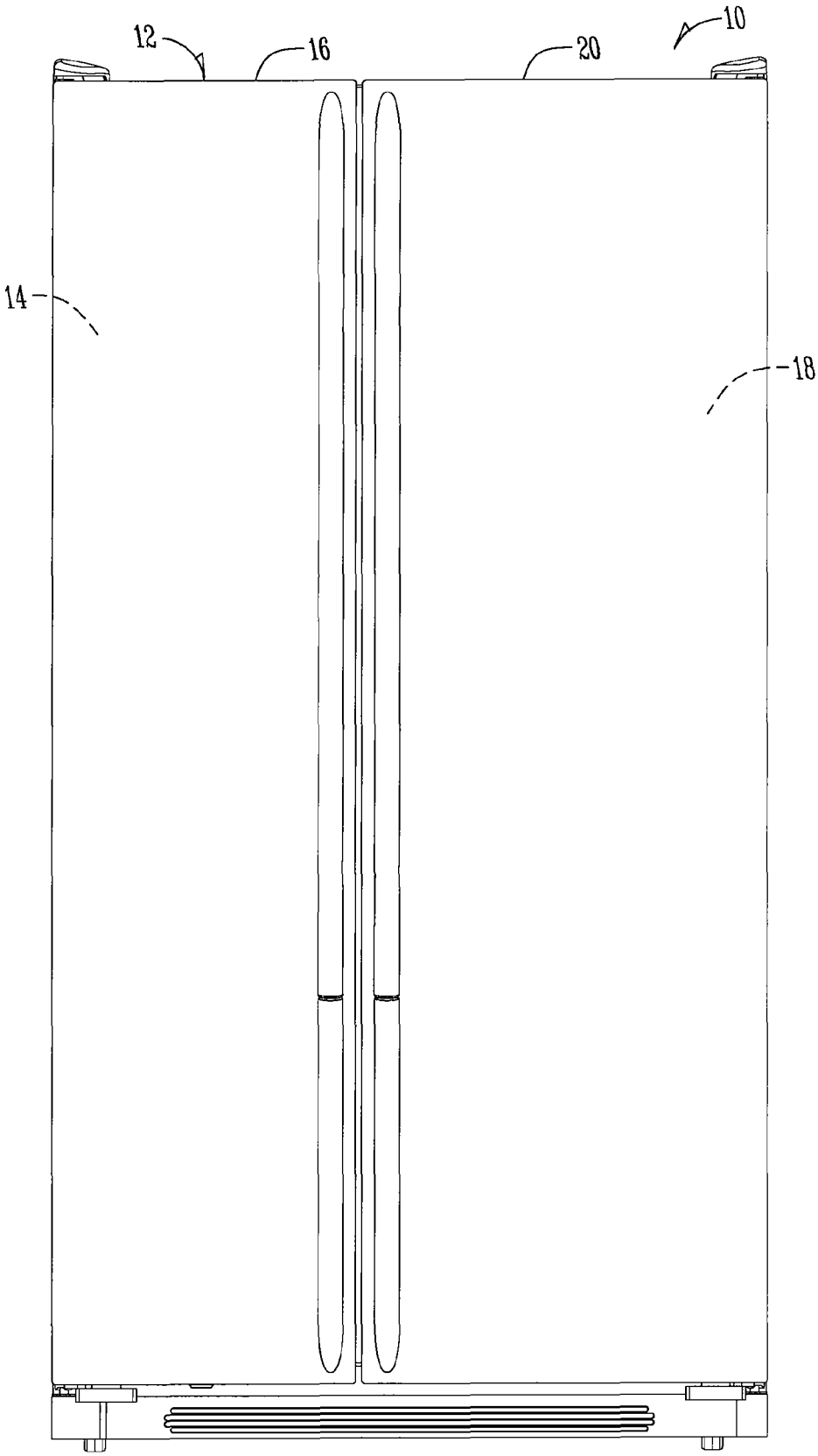
FIG. 1 is a perspective view of a refrigerator.

The present invention provides for a refrigerator which is configured to use a vacuum to improve insulation of the refrigerator. FIG. 1 is one example of a refrigerator of the present invention. The refrigerator 10 includes a refrigerator cabinet or housing 12. Disposed within the refrigerator housing 12 is a freezer compartment 14 with a freezer compartment door 16 providing access to the freezer compartment 14. The present invention contemplates that the present invention may have more or fewer refrigerating compartment. Also disposed within the refrigerator housing 12 is a fresh food compartment 18 with a fresh food compartment door 20 providing access to the fresh food compartment 18. The refrigerator shown in FIG. 1 is a side-by-side refrigerator, however the present invention may be used in a top mount refrigerator, bottom mount refrigerators, and in any number of other configurations of refrigerators.

Figure 2:
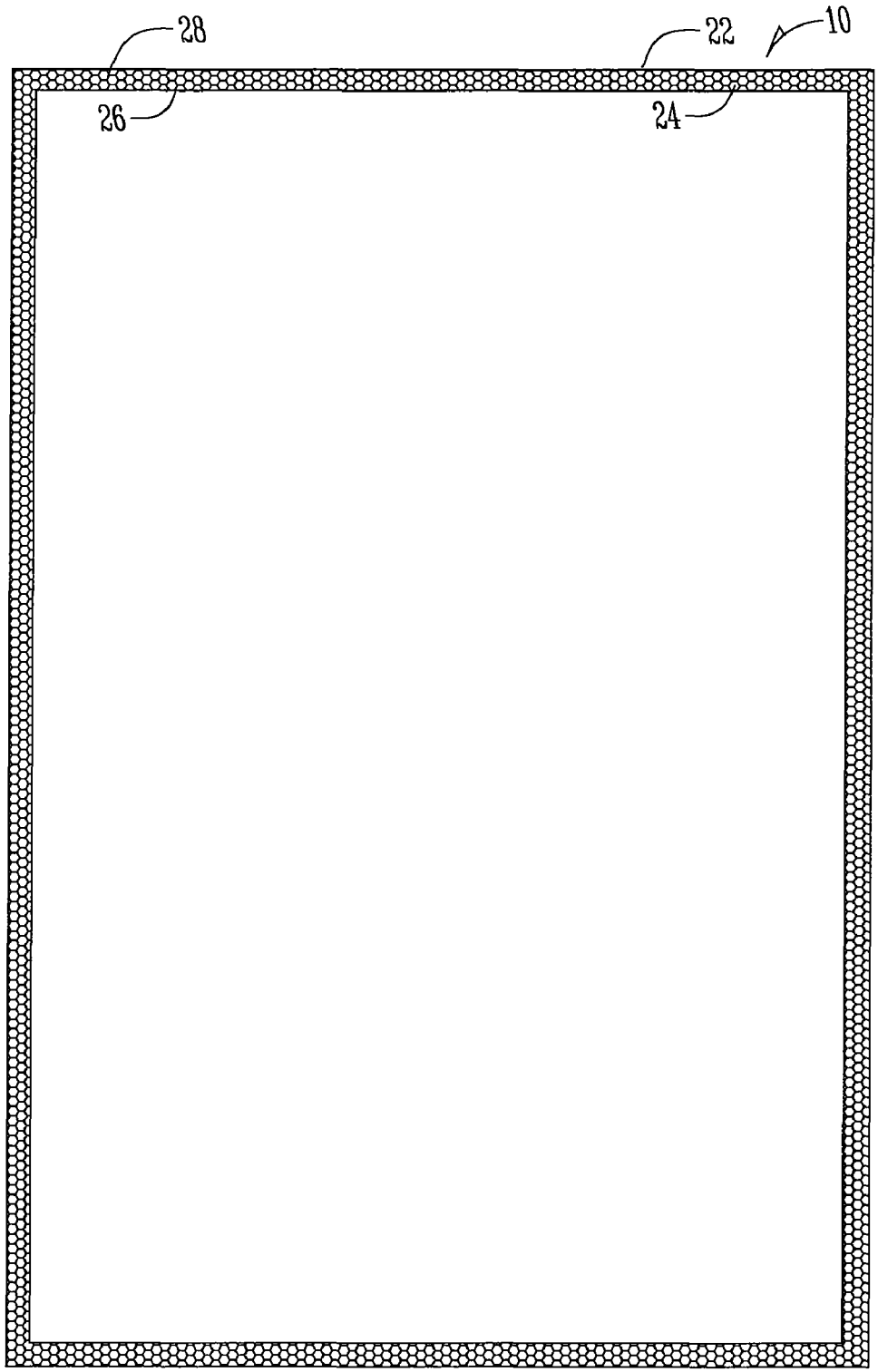
FIG. 2 is a cutout view of the refrigerator cabinet.

FIG. 2 illustrates the refrigerator housing 12. There is an outer shell 22 present as well as a liner 26. Between the outer shell 22 and the liner 26 is foam space 24. The foam space 24 may be filled with foam such as open cell foam 28. As will be explained in greater detail herein, a vacuum pump may be used to pull a vacuum on insulated walls of the refrigerator 10 to assist in insulation of the refrigerator.

Figure 3:
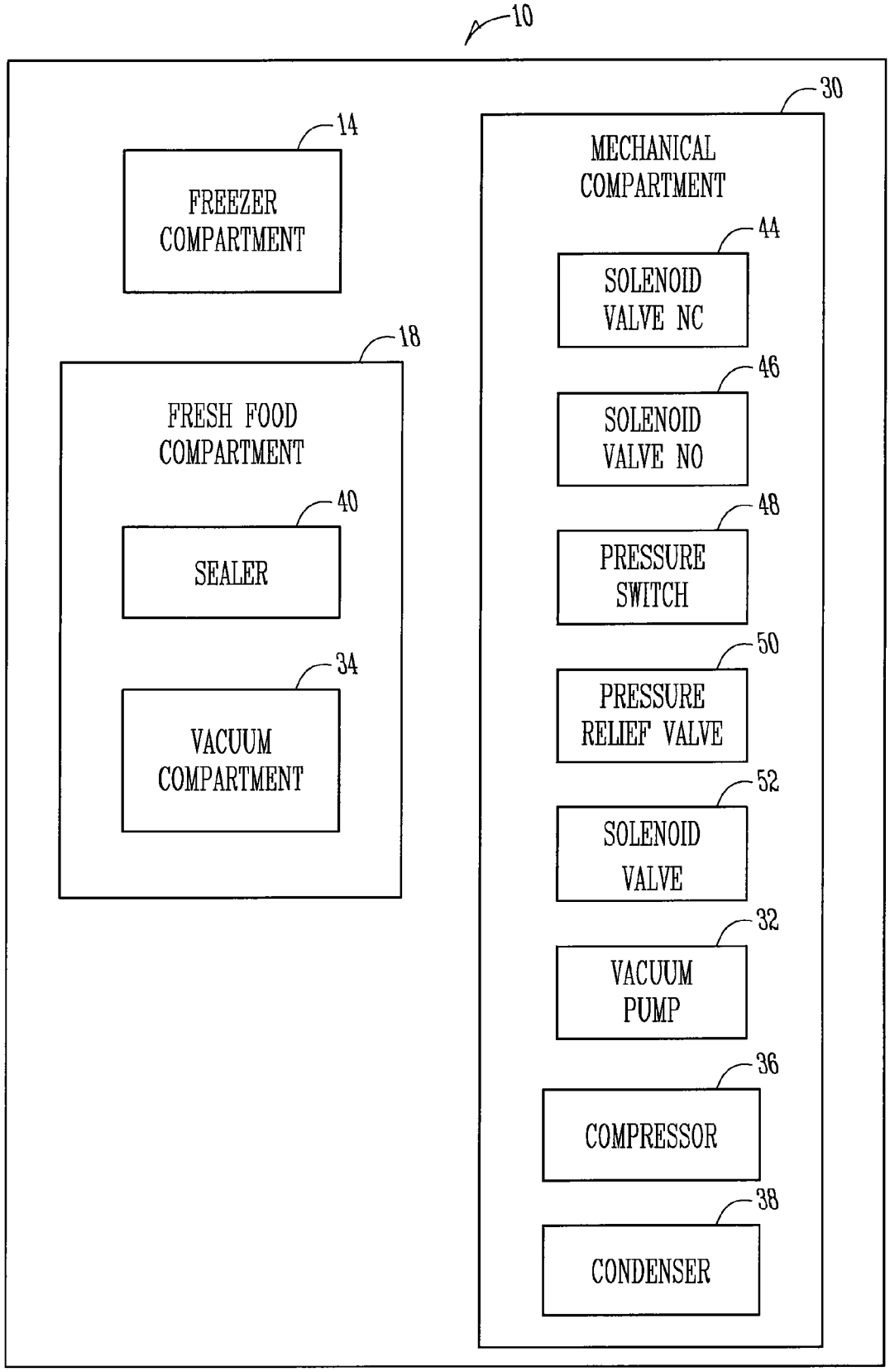
FIG. 3 is a block diagram of the refrigerator compartments and associated components.

As shown in FIG. 3, the refrigerator 10 may have separate compartments such as a freezer compartment 14, a fresh food compartment 18 and a mechanical compartment 30. The fresh food compartment 18 may have a vacuum sealer device 40 and/or a vacuum compartment 34 for fresh food preservation. The mechanical compartment 30 has a compressor 36 and a condenser 38 as is known in the art for cooling the freezer compartment 14 and fresh food compartment 18. In addition, a vacuum pump 32 may be disposed within the mechanical compartment 30. A normally closed solenoid valve 44, a normally open solenoid valve 46, a pressure switch 48, and a pressure relief valve 50 associated with the vacuum pump 32 may also be disposed within the mechanical compartment 30. A solenoid valve 52 may also be present in the mechanical compartment 30. A control system (not shown) may be operatively connected to the solenoid valves 44, 46, the pressure switch 48, the pressure relief valve 50, the solenoid valve 52, the vacuum pump 32, the compressor 36, and the condenser 38.

Figure 4:
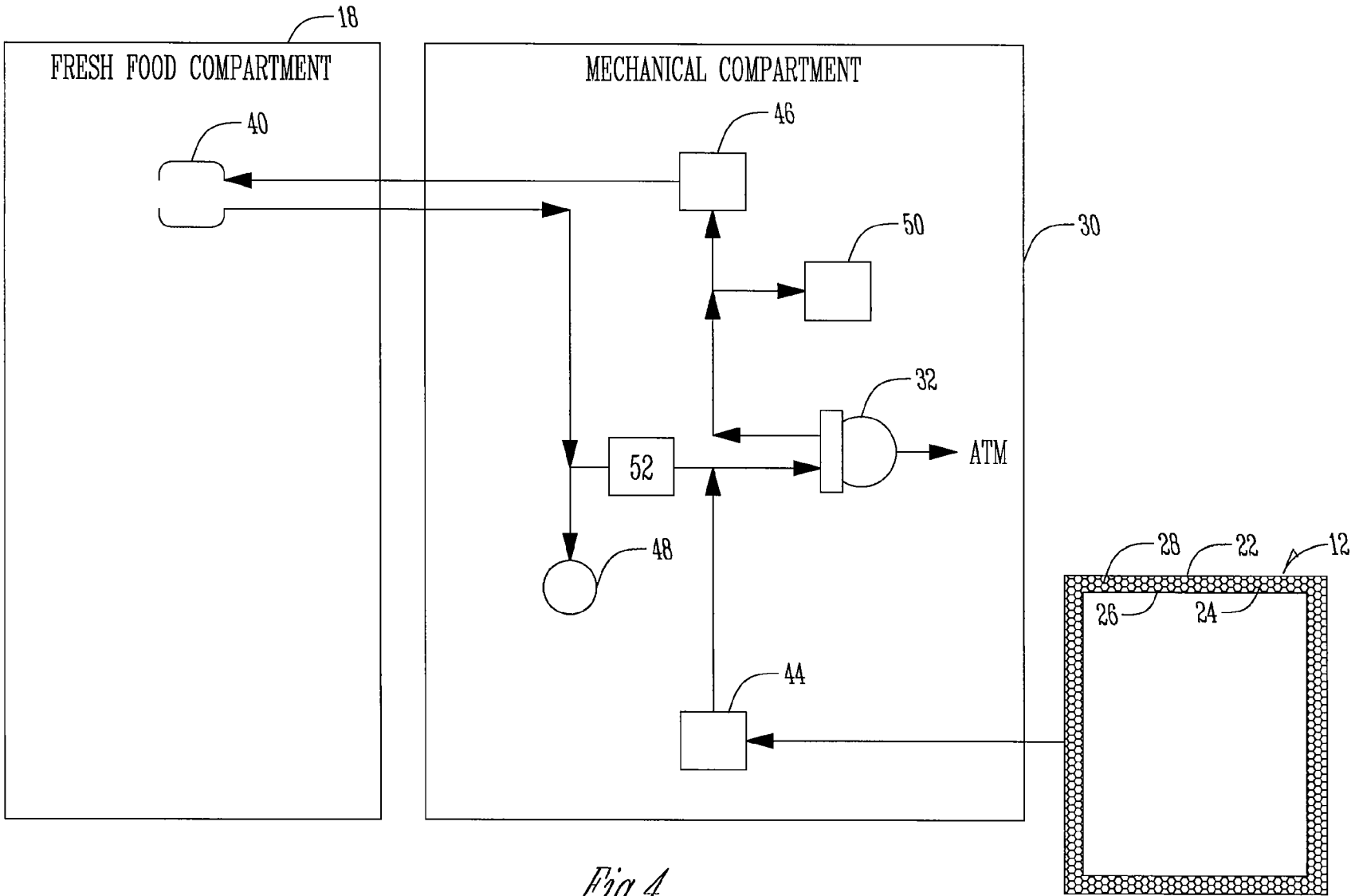
FIG. 4 is a schematic diagram of the sealer apparatus and associated components piping.

As shown in FIG. 4, the cabinet shell 12 maintains a vacuum between the outer shell 22 and the liner 26 of the refrigerator wall such as via a solenoid valve 44. There is a first fluid connection between the vacuum pump 32 and through the solenoid valve 44 to the hollow refrigerator wall to provide for evacuating air from the refrigerator wall. The solenoid valve 44 may be normally open allowing vacuum pump 32 to hold a constant vacuum between the outer shell 22 and the liner 26. When food preservation is desired, the refrigerator control system (not shown) energizes the solenoid valve 44 thus closing the valve 44.

There is a second fluid connection between the vacuum pump 32 and through a normally closed solenoid valve 52 to a vacuum sealer device 40. The closing of valve 44 and simultaneous opening of valve 52 allows the sealer device 40 to function properly when the sealer device is actuated. A vacuum pressure switch 48 may also be actuated by the control system and communicate with the vacuum pump 32 to draw a predetermined vacuum via the sealer device 40. After air is evacuated from the bag in the sealer, solenoid valve 46 is actuated, releasing pressure through a pressure relief valve 50. When food preservation tasks are complete the control system may then re-energize the valve 44 and de-energize the valve 46 and valve 52 to thereby maintain a predetermined or desired level of vacuum in the foam space 24. Thus, the refrigerator 10 may simultaneously maintain a vacuum in the foam space 24 while vacuum pump 32 is being used to perform a second function.

Figure 5:
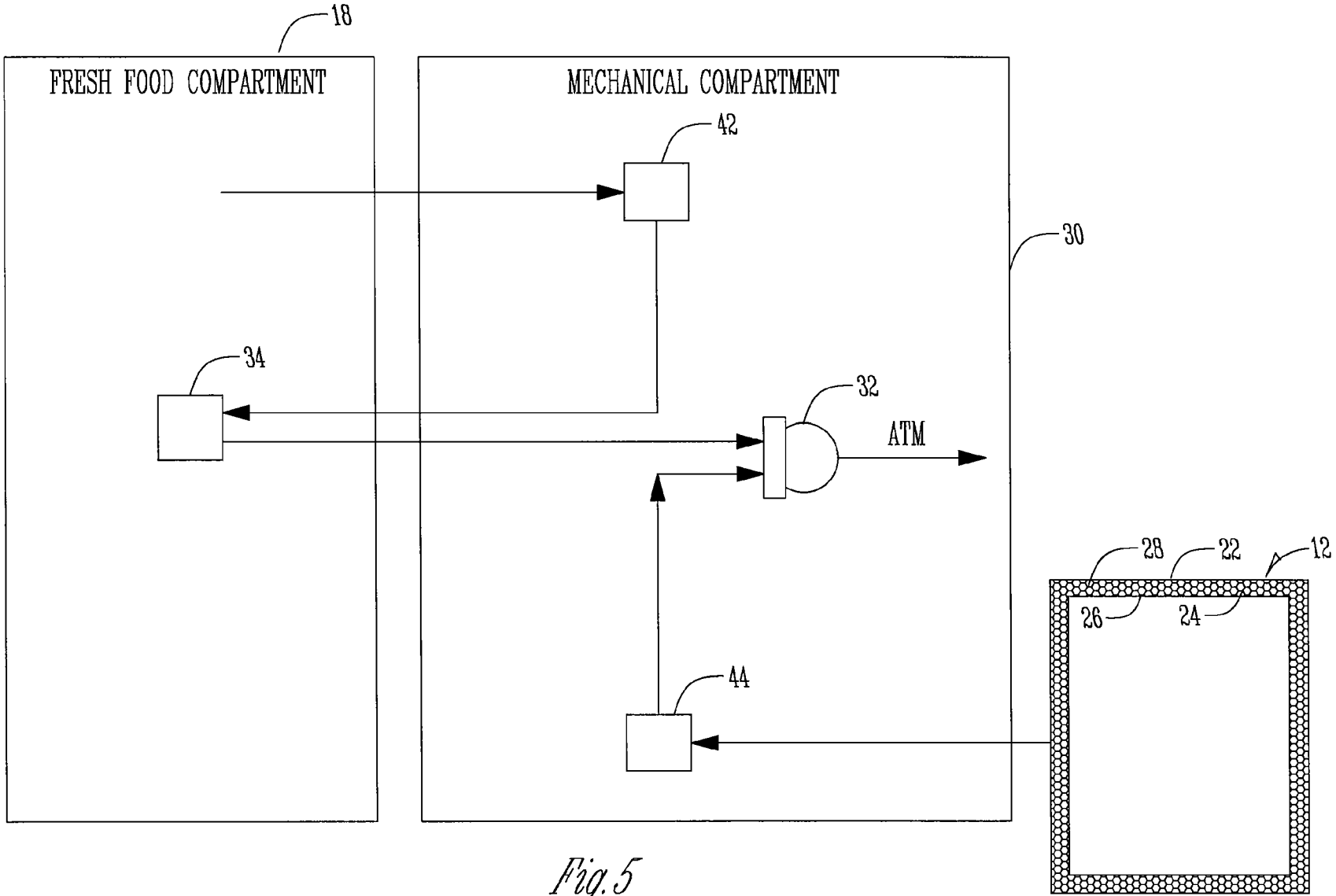
FIG. 5 is a schematic diagram of the vacuum compartment and associated components piping.

In another embodiment shown in FIG. 5, the cabinet shell 12 maintains a vacuum between the outer shell 22 and the liner 26 via the solenoid valve 44. The solenoid valve 44 is normally open allowing a vacuum pump 32 to hold a constant vacuum between the outer shell 22 and the liner 26 and the atmosphere. When the vacuum compartment 34 is closed, the equalization solenoid 42 may be de-energized by the control system and the vacuum compartment 34 may be evacuated through the vacuum pump 32 to atmospheric pressure. Likewise when the vacuum compartment 34 is opened, the equalization solenoid 42 (which may normally be closed) may be energized by the control system and may communicate with the vacuum pump 32 to draw atmospheric pressure from the fresh food compartment 18 which is essentially at the same temperature as the vacuum compartment.

Figure 6:
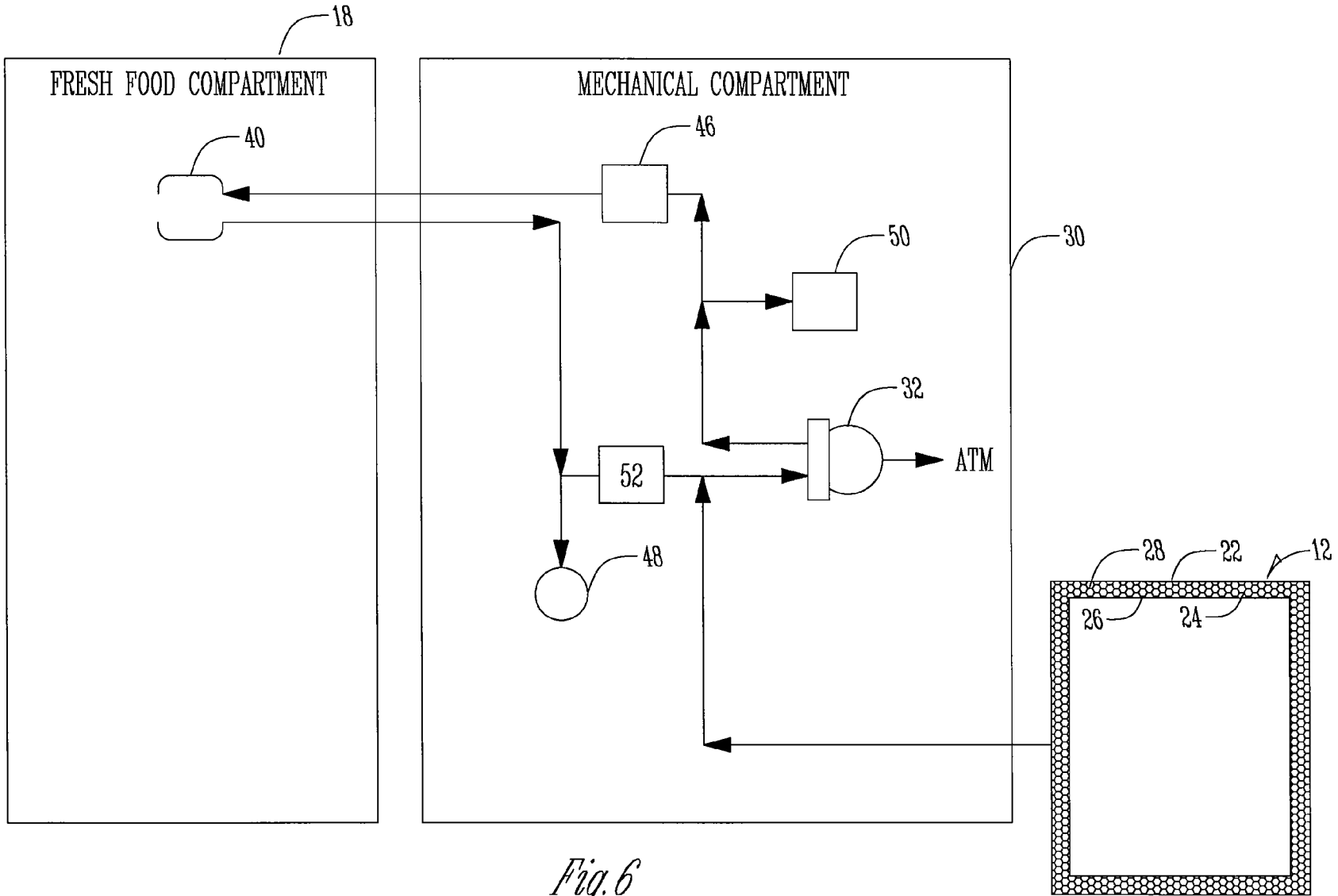
FIG. 6 is a schematic diagram of the sealer apparatus and the vacuum pump piping.

In the embodiment shown in FIG. 6, a solenoid valve is not required to maintain a vacuum between the foam space 24 and the open cell 28. The vacuum pump 32 may be slightly larger in capacity than what is needed for vacuum packaging food with a bag. The larger capacity vacuum pump 32 may continuously provide a vacuum within the outer shell 22 and the liner 26, and thus provide improved thermal characteristics. The opening of valve 52 allows the sealer device 40 to function properly when the sealer device is activated. A vacuum pressure switch 48 may be actuated by the control system and may communicate with the vacuum pump 32 to draw a predetermined vacuum via a sealer device 40 (or vacuum compartment 34). When the sealer device 40 is complete with food preservation, a pressure relief valve 50 may release a predetermined amount of vacuum. When food preservation tasks are complete the control system may de-energize valve 52 and valve 46 to assist in maintaining a predetermined level of vacuum in foam space 24. Similarly for a vacuum compartment or vacuum container valve 44 can be eliminated.

The invention has been shown and described above, and it is understood that many modifications, substitutions, and additions may be made which are within the intended spirit and scope of the invention. For example, although shown on the inside of a machine compartment, the continuous vacuum insulation system need not be placed within the machine compartment. Where a sealer device is present, the sealer device may be placed in any number of locations. In addition, the refrigerator may be of any number of configurations or arrangements. These and other variations, options, and alternatives may be used with the present invention.

What is claimed is:

1. A refrigerator, comprising:

a refrigerator housing;

a refrigerated compartment disposed within the refrigerator housing;

the refrigerator housing comprising a hollow refrigerator wall having insulation material therein;

a vacuum pump;

a first fluid connection from the vacuum pump to the hollow refrigerator wall for providing a first function of evacuating air from the hollow refrigerator wall; and a second fluid connection from the vacuum pump for providing a second function of evacuating air; and wherein the refrigerator being configured to simultaneously perform the first function and the second function.

2. The refrigerator of claim 1 wherein the second fluid connection extends to within the refrigerated compartment to evacuate air from within the refrigerated compartment.

3. The refrigerator of claim 2 wherein the second fluid connection extends to within a compartment within the refrigerated compartment and the second function of evacuating air being evacuating air from the compartment within the refrigerated compartment.

4. The refrigerator of claim 1 wherein the second fluid connection extends to a sealing device and the second function of evacuating air being evacuating air from a container being using with the sealing device.

5. The refrigerator of claim 1 further comprising a vacuum pressure switch operatively connected to the vacuum pump.

6. The refrigerator of claim 1 further comprising a first valve operatively connected to the first fluid connection for controlling vacuum to the hollow refrigerator wall.

7. The refrigerator of claim 6 further comprising a second valve operatively connected to the second fluid connection for controlling vacuum for use performing the second function.

8. The refrigerator of claim 7 wherein the first valve and the second valve are solenoid valves.

9. The refrigerator of claim 8 further comprising a sealing device fluidly connected to the second valve.

10. The refrigerator of claim 9 further comprising a vacuum pressure switch operatively connected to the vacuum pump.

11. The refrigerator of claim 10 further comprising a pressure relief valve operatively connected to the vacuum pump.

12. The refrigerator of claim 1 wherein the insulated material being an open cell foam.

13. The refrigerator of claim 1 wherein the hollow refrigerator wall comprises an outer shell and a liner and the insulated material being between the outer shell and the liner.

14. A method of using a refrigerator, comprising:

providing the refrigerator, the refrigerator comprising (a) a refrigerator housing, (b) a refrigerated compartment disposed within the refrigerator housing, (c) the refrigerator housing comprising a hollow refrigerator wall having insulation material therein, and (d) a vacuum pump;

evacuating air from the hollow refrigerator wall using the vacuum pump;

altering state of a valve associated with the vacuum pump to divert vacuum suction from the vacuum pump for performing a second function, wherein the second function is providing suction to a sealing device of the refrigerator, the sealing device configured to evacuate air from and seal a container.

15. The method of claim 14 wherein the valve is a solenoid valve and altering state of the valve comprises actuating the solenoid valve.

16. The method of claim 15 further comprising evacuating air from the container being sealed by the sealing device.

17. A refrigerator, comprising:

a refrigerator housing;

a machine compartment disposed within the refrigerator housing;

a fresh food compartment disposed within the refrigerator housing;

a freezer compartment disposed within the refrigerator housing;

the refrigerator housing comprising a hollow refrigerator wall having insulation material therein;

a vacuum pump disposed within the machine compartment; and a valve associated with the vacuum pump to divert vacuum suction from the vacuum pump through either a first path to the hollow refrigerator wall to provide a first function of evacuating air from the hollow refrigerator wall or through a second path to perform a second function.

18. A refrigerator, comprising:

a refrigerator housing;

a machine compartment disposed within the refrigerator housing;

a fresh food compartment disposed within the refrigerator housing;

a freezer compartment disposed within the refrigerator housing;

the refrigerator housing comprising a hollow refrigerator wall having insulation material therein;

a sealing device operatively connected to the refrigerator housing;

a vacuum pump disposed within the machine compartment; and a valve associated with the vacuum pump to divert vacuum suction from the vacuum pump through either a first path to the hollow refrigerator wall to provide a first function of evacuating air from the hollow refrigerator wall or through a second path to the sealing device to provide suction to a container being air evacuated and sealed.

* * * * *